US006470947B1

(12) United States Patent
Holevas

(10) Patent No.: US 6,470,947 B1
(45) Date of Patent: Oct. 29, 2002

(54) HIDDEN WINDOW SCREEN FOR SASH WINDOW

(76) Inventor: Michael Holevas, 58-25 229$^{th}$ St., Bayside, NY (US) 11364

( * ) Notice: Subject to any disclaimer, the term of this patent is extended or adjusted under 35 U.S.C. 154(b) by 0 days.

(21) Appl. No.: 09/946,573

(22) Filed: Sep. 5, 2001

(51) Int. Cl.$^{7}$ ..... A47H 1/00
(52) U.S. Cl. ..... 160/28; 160/100
(58) Field of Search ..... 160/27, 28, 99, 160/100, 23.1

(56) References Cited

U.S. PATENT DOCUMENTS 577,690 A * 2/1897 Monroe
587,743 A * 8/1897 Lambert
716,751 A * 12/1902 Phillips
740,033 A * 9/1903 McNamara
998,102 A * 7/1911 Ladwig et al.
2,354,832 A * 8/1944 Ristine
2,462,520 A * 2/1949 Marbach
2,573,590 A * 10/1951 Mosebach
2,826,789 A * 3/1958 Etling
3,017,927 A * 1/1962 Demko
3,244,222 A * 4/1966 Johnson
3,470,934 A * 10/1969 Agnew
3,911,990 A 10/1975 Hoover et al.
5,915,443 A 6/1999 Lindley, Jr.
6,059,007 A * 5/2000 Tomita
6,135,186 A 10/2000 Lineley, Jr.
6,167,936 B1 * 1/2001 Stover et al.
6,223,803 B1 * 5/2001 Nielsen

* cited by examiner

*Primary Examiner*—Blair M. Johnson
(74) *Attorney, Agent, or Firm*—Collard & Roe, P.C.

(57) ABSTRACT

A hidden window screen assembly for a sash window containing a snap-on cover to conceal the rolled-up screen. The screen assembly fits into the upper and lower frame member of a conventional sash window. When the frame member is opened, the rolled-up screen is extended. When the frame member is closed, the screen returns to its rolled-up position, allowing a clear view through the window.

3 Claims, 4 Drawing Sheets

HIDDEN WINDOW SCREEN FOR SASH WINDOW

BACKGROUND OF THE INVENTION

1. Field of the Invention

The invention relates to a hidden window screen for a sash window.

2. The Prior Art

U.S. Pat. No. 5,915,443 shows a means of attaching a screen to the bottom sash by use of a pivotal bar. The screen is pulled out of the bottom of the sill. This system requires enlarging the window frame. U.S. Pat. No. 6,135,186 discloses a screen housing assembly that can be attached to existing windows. The earlier patent to Lindley is not well suited for retrofitting into existing double hung or similar sliding type windows, nor is the screen particularly easy to replace. With this in mind, Lindley improved the screen assembly housing attempting to solve the problem of not enlarging the frame and making it easier to replace the screen. However, this does not solve the problem of dealing with potential water and air infiltration into the system. It also does not seal off the screen entirely from dust and outside elements.

U.S. Pat. No. 6,167,936 discloses a cavity in the lower frame, substantially increasing the lower frame to provide a rolling screen. This still has a problem of replacing the window because it needs to be retrofitted to a new window in a predetermined opening. The increase in the frame will cause loss of daylight. It also does not prevent water infiltration or keep debris out or a quick way of easily replacing the screen.

U.S. Pat. No. 3,911,990 to Hoover provides the screen roller within the frame. This is a favorable solution for not extending the frame and diminish the daylight opening. However, like Lindley's second patent, it is not concealed and will have problems with water and air infiltration, depending on its placement. Hoover also provides a one wipe cleaning system but does not provide an outlet for the dust and water. Furthermore, no solution is provided for preventing water from entering the compartment. Lindley provides a channel for this but the screen roll has absorbed the water before letting it weep out. This will be detrimental to the life of the screen roller mechanism.

SUMMARY OF THE INVENTION

Therefore, it is an object of the present invention to provide a rolling screen system with a snap-on cover. The cover attaches to the existing master frame and forms an opening for the screen to go in and out of. This system solves the problem of keeping water and debris from entering due to its dual sided sweeps. It is another object to conceal the screen entirely from the view from the interior. In addition, a storage tank is provided so that extensive heavy rainfall or in a hurricane situation, water trapped can escape thru a weep system before it can come up and over to the inside of the window causing leakage.

The snap-on cover in the window sill area is concealed when the bottom sash closes over it. Therefore, the window has a clean finish and the presence of a screen housing is hidden. The snap-on cover allows for replacing the screen or screen assembly with ease. The screen roller within the cover will be placed in the upper most part, above the weep system, ensuring that water never reaches the screen roller mechanism, preventing corrosion over time. The cover will also allow the screen to be fed in a direction of option, whether its 90 degrees or 180 degrees, causing the screen to be held taut when the window is opened. This cover is not shown in the cited references and enhances window performance in air and water tests which are common now and of great importance in a sales point of view. Having a concealed screen in corporated within this structure avoids sacrificing any daylight opening.

Having a screen unroll along with the sash window allows the screen to be hidden when not in use, and also extends the life of the screen by always keeping it clean. In addition, it does not obstruct the view through the window, when closed.

In addition, wind will not rattle the screen out of its track, causing harm to one below. This system provides more room in the 3¼" width of the master frame, which is a critical width to maintain in the retrofit window design, by eliminating the wide channel that is needed to guide the convention screen frame. This extra space can now be added to increase the sash width, creating a more structural window with an increased glass width, further enhancing thermal properties of a double paned window.

Air and water tests governed by AAMA, (American Architectural Manufacturers Association), rate windows according to performance against simulated air and rainstorms equivalent to hurricane levels. This system effectively conceals a screen without compromising daylight opening, without compromising the performances of air and water infiltration, and also enhances a windows performance.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
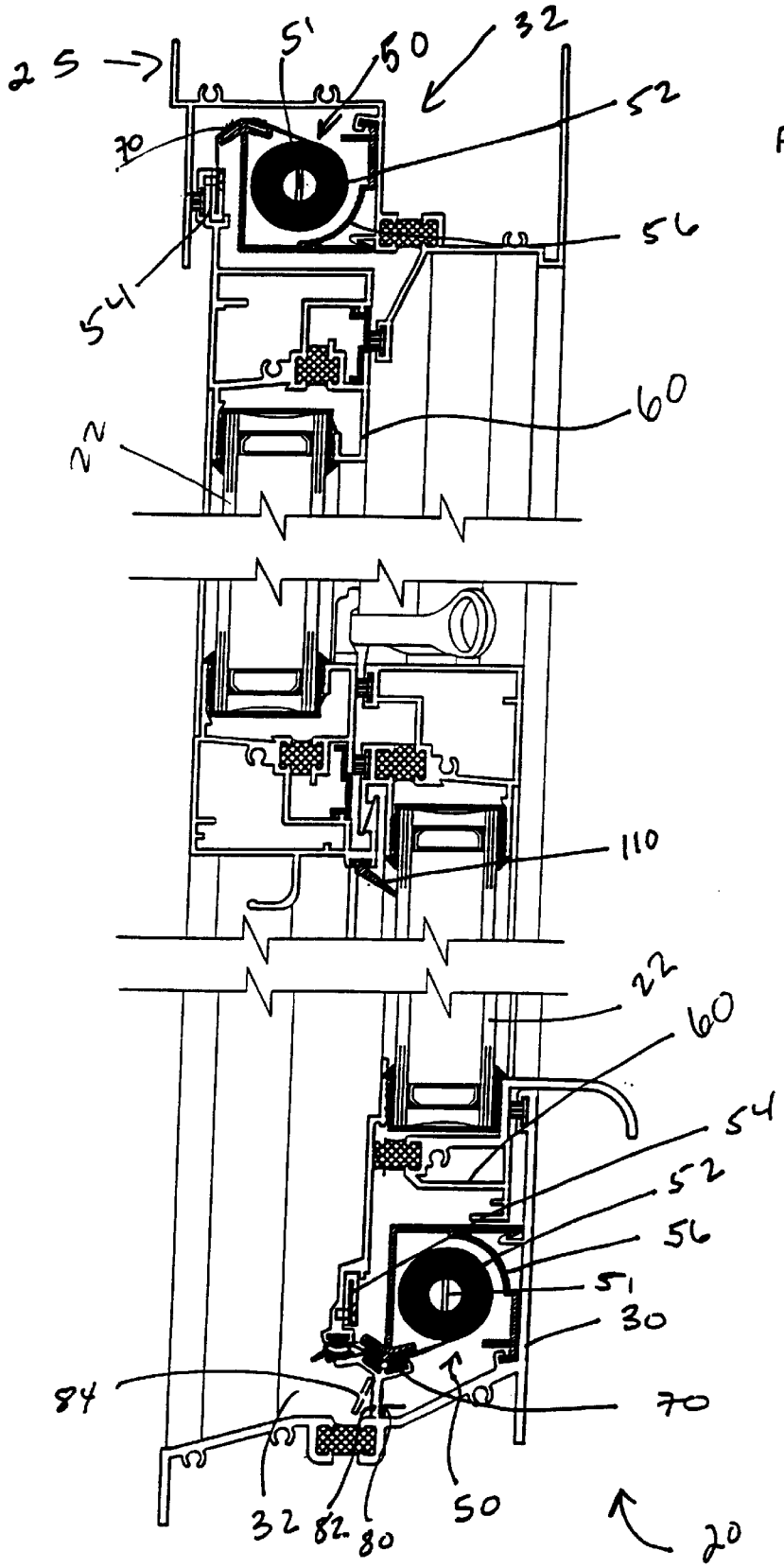
FIG. 1 shows the hidden window screen system according to the present invention.
Figure 2:
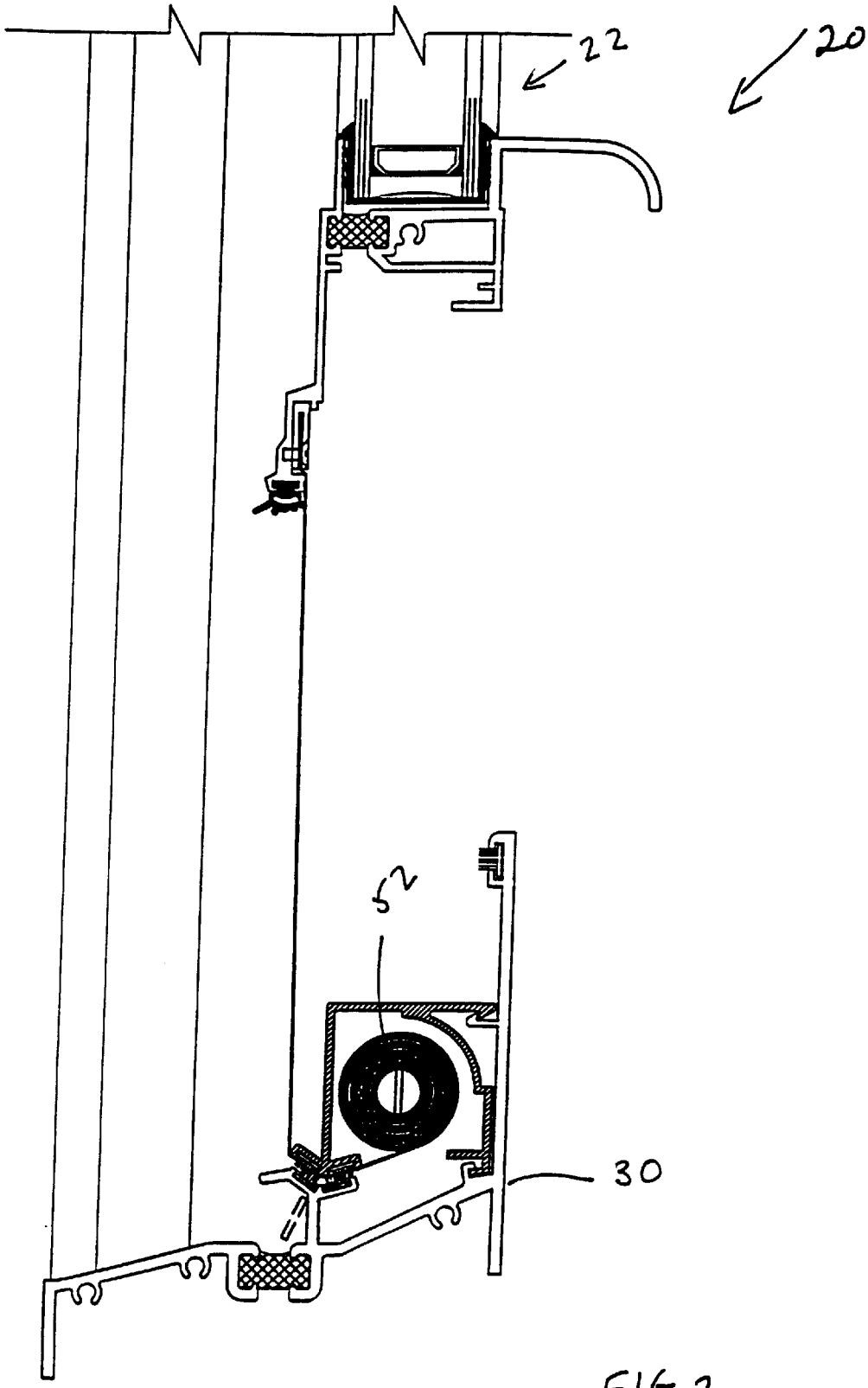
FIG. 2 shows the system in its open position.

Referring now in detail to the drawings and, in particular, FIGS. 1–2 illustrate a window assembly 20 having a rolling screen assembly 50 according to the present invention. The window assembly 20 is preferably a double-hung window assembly such as used for residential or commercial buildings. The window assembly 20 preferably has an upper and lower window sash 22 which has a substantially rectangular shape with an upper end frame member 25, and a lower end frame member 30. Sash 22 contains a rail 60. The lower end frame member 30 and upper end frame member 25 have an elongate cavity 32.

The hidden screen system contains a rolled-up screen mesh 52 attached to sash rail 60 by a continuous clip 54. A snap-on housing 56 attaches to lower frame 30 for concealing the screen system. Rolled-up screen 52 is positioned in cavity 32 of the upper and lower frame member. A roller 51, is mounted in cavity 32 and rolled-up screen 52 is mounted on roller 51. Roller 51 is of the same spring loaded system found in conventional vinyl shades.

Bristles 70 clean rolled-up screen 52 as screen 52 is extended and then returned to its rolled-up position. This cleaning mechanism substantially extends the life of the screen. A weeping system 80 contains a weep hole 82 and a hole cover 84 for allowing excess water trapped inside cavity 32 to weep out, preventing damage to the screen.

A gasket 110 disposed between the two sashes for preventing insects from entering.

FIG. 2 shows the screen assembly in its open position. For example, when lower sash member 22 is moved upward, rolled-up screen 52 unrolls to extend over the window opening. When the lower sash member 22 is lowered to its shut position, screen 52 is returned to its rolled-up position, allowing an unobstructed view through the window glass.

Figure 3:
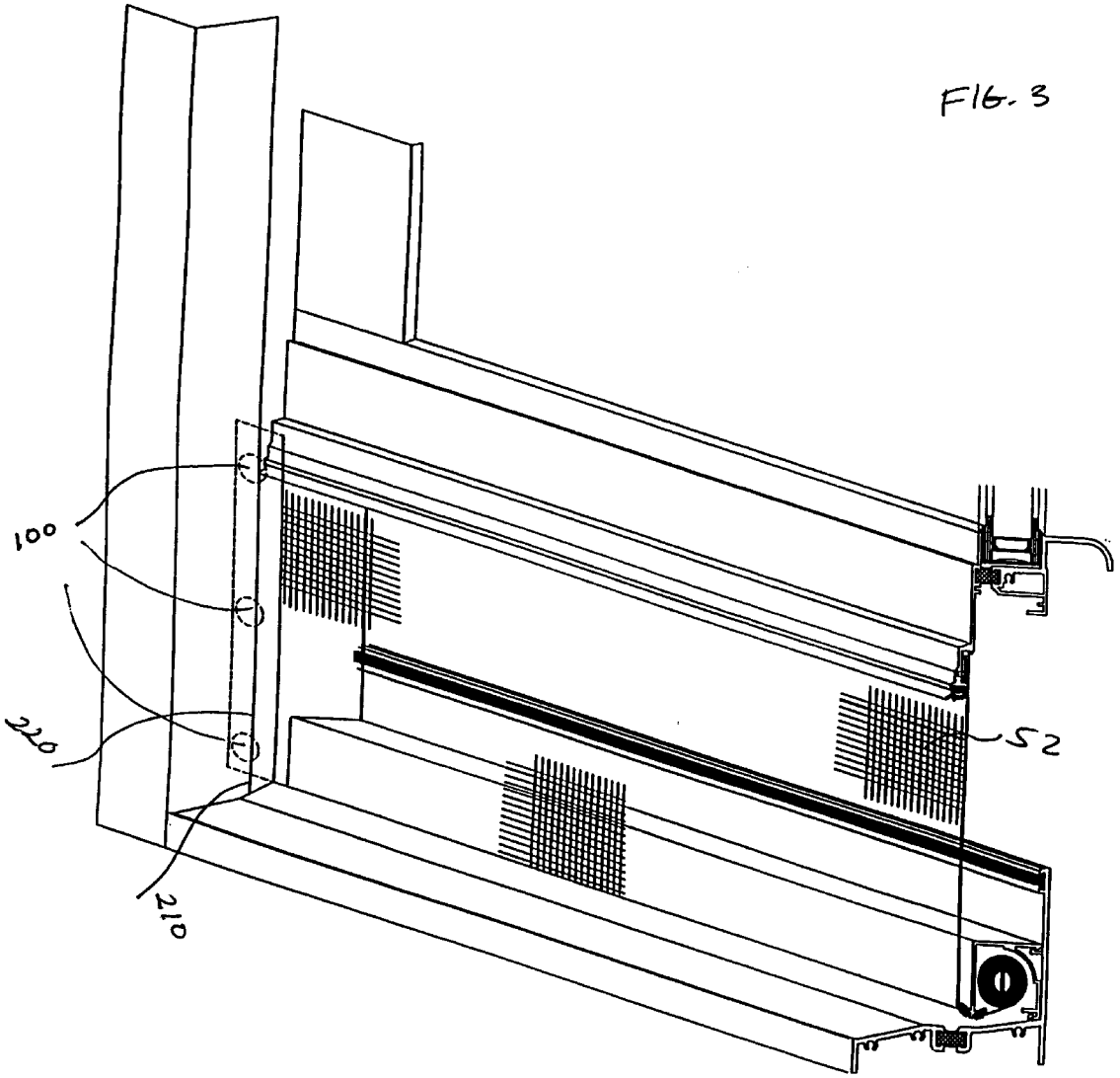
FIG. 3 shows the system being detachable from the window track.

FIG. 3 shows a further embodiment of the present invention. Grommets 100, which can be of vinyl or similar material adhered by means of heat weld or other method and having reinforcing properties to the sides of the screen. Grommets 100 allow screen 52 to be fastened to a track 210 of the window frame.

These grommets prevent the screen from detaching from the window track in the event of applied pressure by a child, pet, etc. As the screen is unrolled, grommets 100 secure to a rolling sprocket 220 preventing the screen from detaching.

Figure 4:
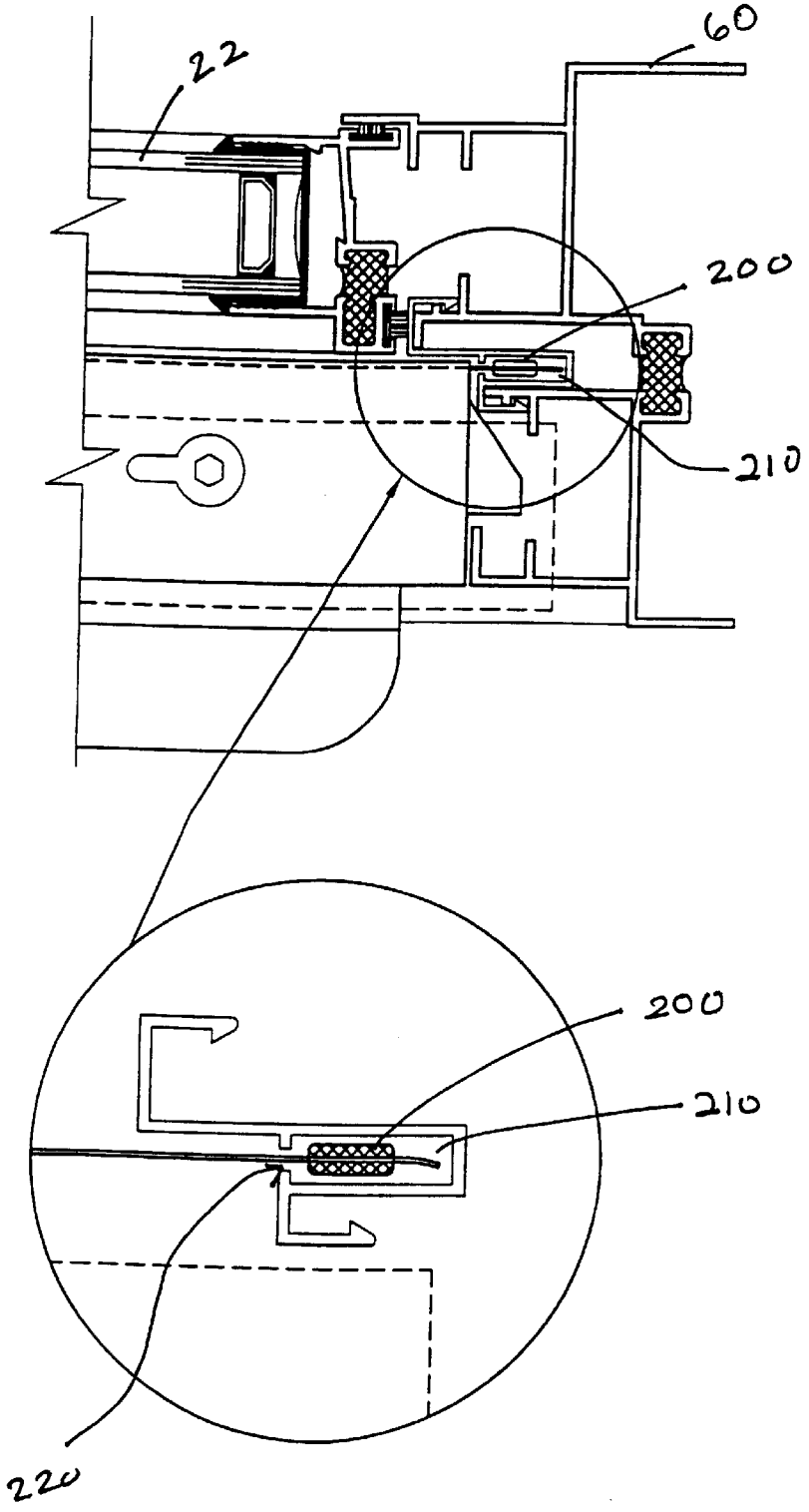
FIG. 4 shows the system with the screen guided through channeling and being secured within.

FIG. 4 shows another embodiment of the present invention using buttons or tabs 200 rather than grommets. The buttons can be adhered to the sides of the screen and are channeled up and down along with the screen to secure the screen's edges to the guide channel 210. The buttons are fed through the bottom of a guide rail as the screen rolls up and vice versa for the top screen. The top screen is fed into another channeling from the top down. The buttons or tabs prevent the screen from pulling out of the guide rail and opening 220 of channel 210.

Accordingly, while only a few embodiments of the present invention have been shown and described, it is obvious that many changes and modifications may be made thereunto without departing from the spirit and scope of the invention.

What is claimed is:

1. A rolling screen assembly in combination with a sash window having an upper frame member and a lower frame member, the assembly comprising:

at least one rolled-up screen;

a plurality of clips for attaching said at least one rolled-up screen to the upper frame member or the lower frame member of the sash window;

a snap-on housing disposed around each rolled-up screen, wherein said snap-on housing is adapted to snap onto the frame member to which said rolled-up screen is attached, and wherein said snap-on housing comprises an upper edge portion;

a series of bristles disposed on said upper edge of said snap-on housing for cleaning said rolled-up screen during operation;

a series of bristles disposed on the frame member to which said rolled-up screen is attached, wherein said series of bristles disposed on the frame member and said series of bristles disposed on said edge of said snap-on housing achieve a dual sided sweep of said rolled-up screen during operation of said rolled-up screen; and a weep system disposed in the lower frame member for allowing excess water to be expelled, wherein said weep system is spaced apart from said rolled-up screen ensuring that water in said weep system never reaches said rolled-up screen;

wherein when an upper or lower sash of the sash window is in an open position, said at least one rolled-up screen is extended.

2. The rolling screen assembly according to claim 1, wherein said at least one rolled-up screen comprises button tabs for engaging a guide channel that prevents said at least one rolled-up screen from detaching.

3. The rolling screen assembly according to claim 1, wherein said weep system comprises weep holes and hole covers for allowing water to seep out.

* * * * *